US005407018A

United States Patent [19]

Henry

[11] Patent Number: 5,407,018

[45] Date of Patent: Apr. 18, 1995

[54] PNEUMATIC IMPACT TOOL HAVING IMPROVED VIBRATION AND NOISE ATTENUATION

[75] Inventor: Edgar G. Henry, Kirtland, Ohio

[73] Assignee: TC Services, Highland Hts., Ohio

[21] Appl. No.: 179,265

[22] Filed: Jan. 10, 1994

[51] Int. Cl.[6] ..... B25D 17/11

[52] U.S. Cl. ..... 173/211; 173/162.1

[58] Field of Search ..... 173/210, 211, 162.1, 173/DIG. 2

[56] References Cited

U.S. PATENT DOCUMENTS

| | | | |
|---|---|---|---|
| 1,220,100 | 3/1917 | Haeseler | 173/210 |
| 1,896,992 | 2/1933 | Agren | 173/211 |
| 2,372,029 | 3/1945 | Stair | 173/211 |
| 3,661,216 | 5/1972 | Yamanake | 173/210 |
| 3,783,970 | 1/1974 | Danielson | 173/211 |
| 4,548,278 | 10/1985 | Gidlund | 173/211 |

*Primary Examiner*—Scott A. Smith

*Attorney, Agent, or Firm*—John F. McDevitt

[57] ABSTRACT

Vibration and noise are considerably reduced in a pneumatic impact tool employing a reciprocating work member such as a chisel or hammer by providing composite elastomeric attenuation element in the tool construction. A laminar configuration of the attenuation elements is employed having dual outer layers of elastomeric material in combination with a rigid inner layer and with such attenuation elements being located in the tool construction for physical impact by the work member.

14 Claims, 2 Drawing Sheets

PNEUMATIC IMPACT TOOL HAVING IMPROVED VIBRATION AND NOISE ATTENUATION

BACKGROUND OF THE INVENTION

This invention relates generally to a hand-operated pneumatic power tool having improved means for attenuation of both vibration and noise when being operated and more particularly to the construction of such type tool device which employs a reciprocating work member such as a chisel, hammer or the like.

Various means are already known to nullify or reduce considerable impact otherwise experienced by operators of pneumatic power tools, both hand-held and hand-operated, to include chippers, hammers, tampers, jackhammers and the like. In addition to requiring considerable strength to operate such tools, the continuous comparatively large amplitude impacting mechanical forces associated with the recoil reaction of the reciprocating work member often results in serious physical harm to the tool operator. Thus, there has long been a need for vibration attenuation in such pneumatic powered impact tools so that little if any cyclical impact forces will be transmitted to the tool operator. Likewise, various federal and state governmental agencies are becoming increasingly concerned with a serious need to reduce noise in the work place based on either health considerations for the work force or disturbance to the surrounding population.

Pneumatic dampening of the reciprocating work member has been employed in one known means to secure vibration attenuation for a variety of such impact tools. For example, such pneumatic attenuation means are disclosed in U.S. Pat. No. 3,456,744 whereby the recoil of a free piston member in such type device is dampened with a pneumatic counter force. As therein described at the time the piston starts backward movement there is gas pressure between the Forward face of the piston and the tool member tending to drive the piston backward. The volume between the rear of the piston and the closed end of a movable sleeve member is vented to the atmosphere. As the piston moves backward the movable sleeve member moves forward under gas pressure in a peripherally located chamber between said sleeve member and a further tool member in the device and between the forward face of the piston and the sleeve member. As the sleeve member moves forward, a passage is closed thereby trapping gas between the rear face of the piston and the closed end of the sleeve member. Also, the volume between the piston and tool bit is closed thereby retaining the gas therein which expands as the piston moves to the rear. Compression of the gas in the volume between the rear face of the piston and the closed end of the sleeve member tends to decelerate both the piston and the sleeve member without imparting cyclic recoil forces to the tool member, barrel member or the handle in said device. A similar vibration dampening mechanism is described in U.S. Pat. No. 4,398,411 wherein the vibration and recoil otherwise experienced during operation of a rivet bucking tool is absorbed in the tool housing with compressed air being introduced into a dampening chamber. The pressure of the introduced air from an outside source is made adjustable with valve means while a further O ring element in this tool construction is also reported to resiliently dampen forward impact by the reciprocating piston.

Still other type deformable attenuation means have been utilized in pneumatic impact tools to minimize vibration, including employment of elastomeric buffers and mechanical springs. For example, a hand-held pneumatic powered tool of this type is disclosed in U.S. Pat. No. 5,054,562 which is constructed of rigid parts isolated from each other by elastomeric shock-absorbing material arranged between the parts in laminar fashion in which certain of the layers are of a different Shore A hardness as respects each other. The layers are reported to be formed with different thickness which are introduced into an annular space between the parts in pourable condition, each layer being permitted to setup before the next layer is poured, which results in bonding of the elastomeric layers to each other as well as to the parts. A novel supporting structure is reported to be disposed between the parts to space them in condition to receive the elastomeric material and the structure is permitted to remain between the parts in such isolated or shock-absorbing fashion as to improve the vibration-minimizing characteristic of the overall construction. Elastomers reported to be useful for such device construction are any of the known liquid polyurethane types pourable at room temperature or up to about 100° F. and with decreasing Shore A hardness being exhibited in successive layers of the poured elastomer.

It is an object of the present invention to provide still further improved means for vibration and noise attenuation in a pneumatic impact tool requiring only a relatively simple modification of the existing tool construction.

A still further object of the present invention is to provide the desired improvement in a distinctive manner involving cooperation between component parts of a multi-part attenuation means.

It is yet another object of the present invention to provide the desired improvement in a variety of pneumatic powered impact tools including the type employing a replaceable reciprocating impact member.

These and still further objects of the present invention will become apparent upon considering the following detailed description of the present invention.

SUMMARY OF THE INVENTION

Novel means have now been discovered for a variety of pneumatic powered impact tools which serve more effectively to reduce both vibration and noise during device operation. More particularly, said novel attenuation means are found to provide in a unique interaction better absorbing vibration and noise within the device itself. In doing so, a multi-part construction for said attenuation means is provided having a laminar configuration formed with dual outer layers of elastomeric material having a rigid inner layer interposed therebetween. A useful construction for said improved attenuation means can consist simply of having a steel inner layer physically sandwiched between outer layers of conventional elastomers, to include synthetic rubber or polyurethane, as well as having such outer layers adhesively bonded directly thereto. By further physically disposing such attenuation means in the impact tools so that it physically counters the reciprocating impact member during recoil, a novel transfer of mechanical energy is enabled to proceed from said impact member to the attenuation means. The transferred mechanical energy from said impact member is first absorbed and partially dissipated by deformation of the elastomeric outer layer being contacted which then transfers the absorbed energy to the rigid inner layer component where the absorbed energy is both dissipated in adjoining parts of the impact tool as well as still further absorbed in the remaining elastomeric outer layer where additional dissipation takes place. The described arrangement for the attenuation means in said impact tools has thereby been found to dissipate greater amounts of both vibration and noise within the tool device itself.

DETAILED DESCRIPTION OF THE PREFERRED EMBODIMENTS

Figure 1:
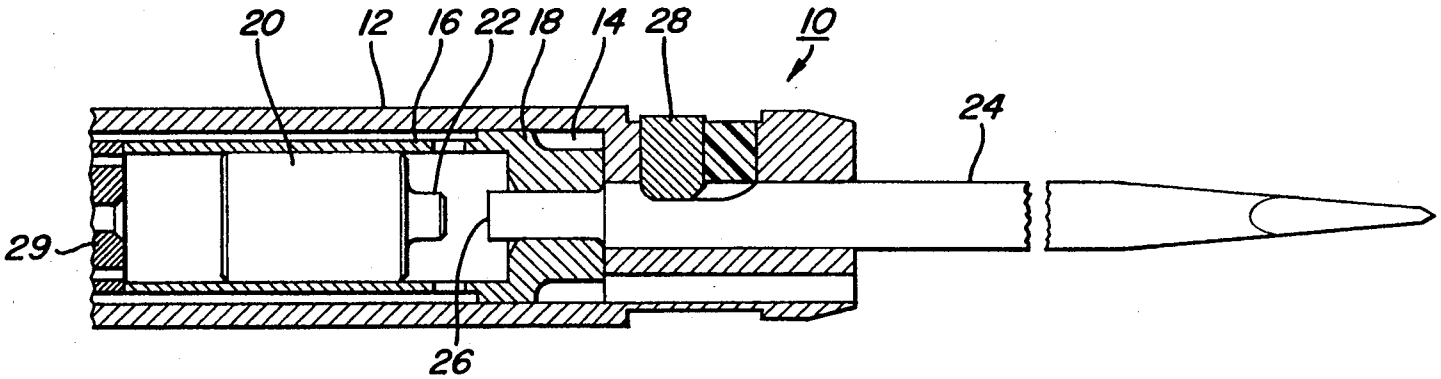
Fig. 1 (PRIOR ART)
FIG. 1 is a side view partially in cross section for a prior art hand-held pneumatic power tool lacking attenuation means.

Referring to the drawings, there is shown in FIG. 1 a side view partially in cross section for a typical prior art hand-held pneumatic powered impact tool 10 now commonly employed to remove weld flux scale in the metal industry. As can be noted, the depicted tool construction lacks handle means with the tool operator holding this device with a hand-held grip being placed about the outer circumference of the tool housing 12. It is to be particularly further noted and understood, however, that the depicted hand-held tool represents only one kind of pneumatic powered impact tool device which can be advantageously operated with the present attenuation means hereinafter further described. The depicted housing 12 is of a hollow cylindrical construction having a central passageway 14 which incorporates a hollow sleeve member 16 closed at its front end 18 and which is fixed within the housing passageway by a press fit. A free piston cylinder 20 is slidably engaged by slip fit within said hollow sleeve member which terminates at its front end in a smaller projection 22 to make physical contact with a reciprocating impact chipping chisel 24 when said piston moves sufficiently in the forward direction. Such physical contact with the impact member takes place at a smaller back end face 26 provided in the further slidably engaged impact member. Retention of impact chisel 24 in the tool housing is provided with retainer means 28 which further enables impact tool replacement as well as substitution of a dissimilar impact tool member. A conventional pneumatic valve mechanism 29 supplies a pressurized gaseous medium, such as air, to drive the piston forward and back in cooperation with cyclical movement caused by collision between the moving piston and impact members. Understandably, such collisions occur repeatedly when the forward moving piston contacts the impact member as well as when the piston is caused to move backward when disturbed by action of the recoiling impact member. Absence of any shock-absorbing medium in the depicted tool embodiment allows vibration and noise to escape with virtually no internal attenuation taking place in such tool device.

Figure 2:
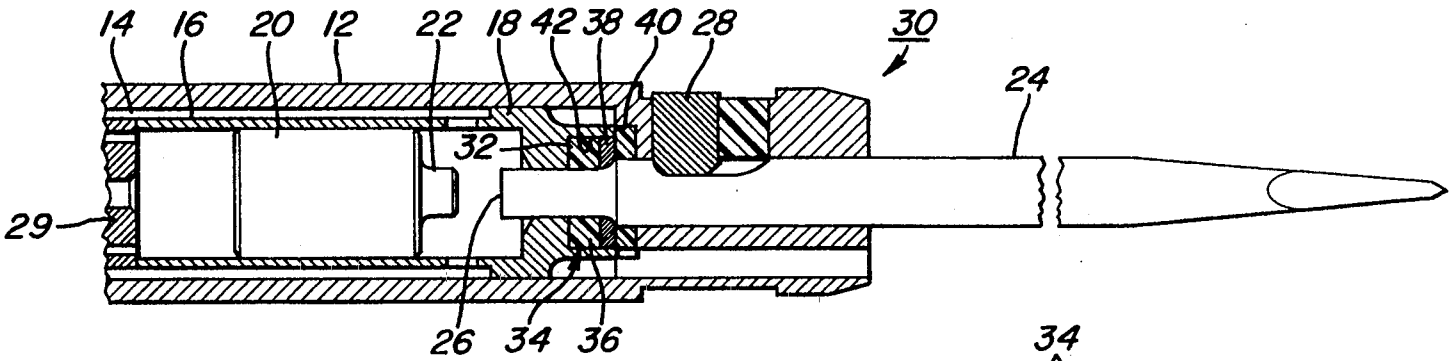
FIG. 2 is a side view partially in cross section for the power tool in FIG. 1 which has been modified according to the present invention.

In FIG. 2 a similar cross sectional view is shown of the FIG. 1 tool embodiment after modification to incorporate attenuation means of the present invention. Accordingly, the same numeral identification employed in FIG. 1 is retained in the present drawing to identify common parts in the tool construction. Said modified tool embodiment 30 now includes a multi-part vibration and noise attenuation means 32 interposed between the front end of hollow sleeve member 16 and reciprocating impact member 24. As can be seen, said attenuation means 32 has a laminar configuration 34 formed with a first outer layer 36 of solid elastomeric material such as, rubber or polyurethane, a rigid metal inner layer 38, such as steel, and a second outer layer of solid elastomeric material 40 which can have the same or dissimilar material composition as the material composition employed in the first outer layer. A circular grooved depression 42 has also been provided in the front end nose 18 of hollow sleeve member 16 to simply hold elements 36 and 38 of the employed attenuation means in place during tool assembly and operation since no further bonding together of component parts in the present attenuation means is required to produce the improved device performance. Accordingly, remaining element 40 in the depicted attenuation means simply presses against the front nose end of hollow sleeve member 16 while forming a contact interface when reciprocating impact member 24 is caused by recoil action to strike the front nose end of the sleeve member. Requiring the impact tool to first encounter the present attenuation means in such manner enables the impact tool to counter act the mechanical force otherwise transmitted directly to the tool housing during device operation. As earlier pointed out, a novel transfer of mechanical energy imparted to the impact tool by collision with the work surface takes place when said impact tool thereafter engages with the present attenuation means. A substantially greater amount of the transferred mechanical energy is thereby enabled to be absorbed within the tool device itself so as not to produce external vibration causing excessive noise and/or harm to the tool operator.

Figure 3:
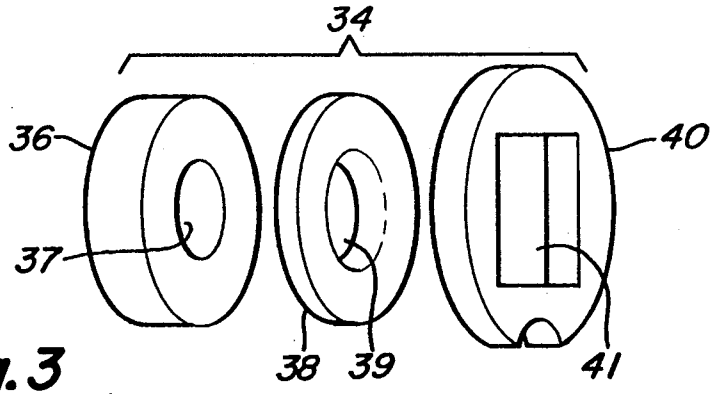
FIG. 3 is a perspective view depicting the vibration and noise attenuation means being employed in the FIG. 2 tool construction.

FIG. 3 is an exploded perspective view depicting the vibration and noise attenuation means being employed in the FIG. 2 construction. Accordingly, the same numeral identification employed in FIG. 2 is again retained in the present drawing to identify the common elements of construction for said attenuation means. First elastomeric outer layer 36 has a circular disc-like configuration with a central opening 37 being provided to enable passage therethrough of the back end of impact member 24 as physical contact takes place between the impact member and the cooperating outer layer 40. Similarly shaped intermediate steel element 38 includes a central opening 39 for the same purpose while a central opening 41 provided in said cooperating elastomeric outer layer 40 has a dissimilar configuration to accommodate physical size and shape changes provided in said previously depicted impact member. It can be further appreciated that while specific elements of the herein depicted attenuation means are not required to be bonded together as a unitary structure in order for improved tool operation to occur that such a unitary construction for the present attenuation means is also contemplated. Thus conventional adhesive bonding of the elastomeric outer layers to the rigid inner layer will be apparent and which can be further carried out with and without available adhesive materials. A preferred elastomeric material for construction of the herein represented attenuation means is the solid polyurethane sheet material being sold by Aetna Plastics Corporation, Cleveland, Ohio 44114 with a Shore A 60 hardness.

Figure 4:
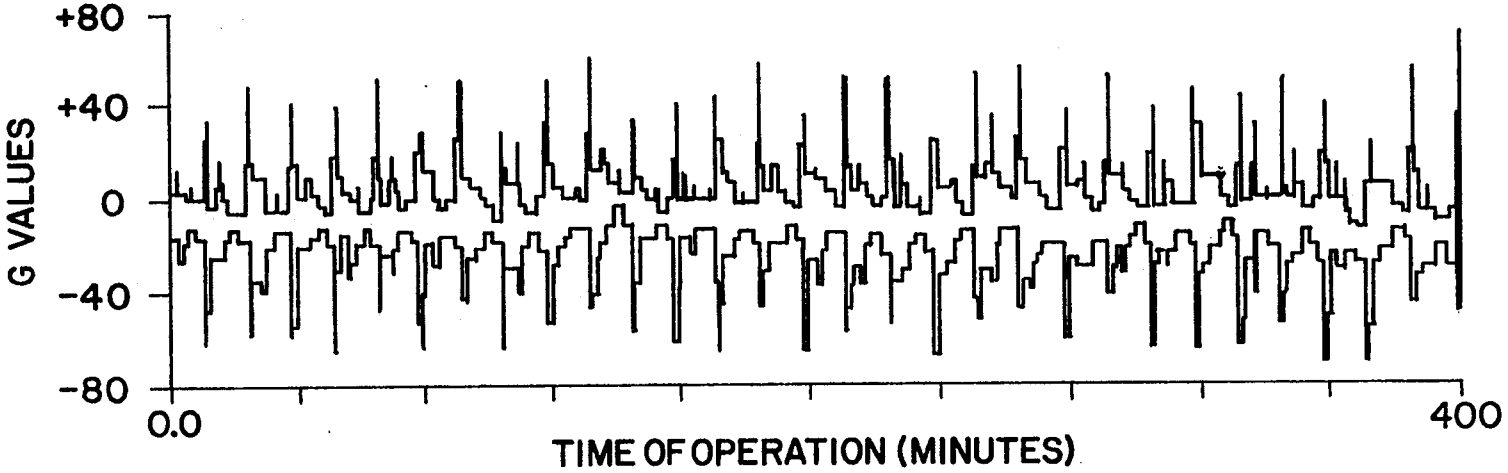
FIG. 4 is a graph of the vibration being experienced with the FIG. 1 tool construction.
Figure 5:
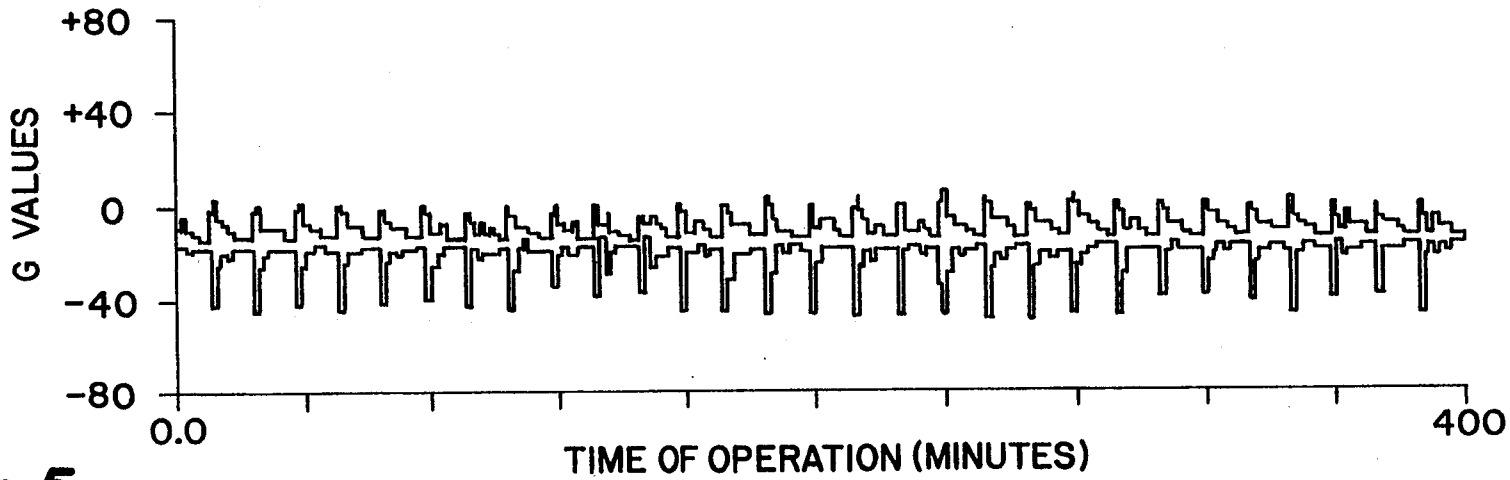
FIG. 5 is a graph for the vibration experienced with the FIG. 2 tool construction under the same test conditions.

A comparative evaluation of the vibration being experienced during tool operation was carried out for both tool constructions described in FIGS. 1 and 2. In doing so, each tool construction 10 and 30 was mounted in a test stand enabling vibration measurement while being operated to be made with conventional accelerometer sensing means. A further conventional dynamic signal analyzer instrument was employed to provide said vibration measurements in terms of conventional gravity acceleration values (G) perceived during the time interval of operation being measured. FIG. 4 provides these test results for the FIG. 1 tool embodiment which demonstrated G values reported on the ordinate scale of said graph to range between at least +40 and −40 during a 400 minute time interval of tool operation that is reported on the graph abscissa. A like measurement under the same test conditions for the FIG. 2 tool embodiment is reported in FIG. 5. As can be seen, far less vibration was experienced during tool operation with the employed attenuation means as demonstrated by G values ranging from between only about 0 and 40. The tool operator also reported observing far less noise during these comparative measurements when operating the FIG. 2 tool embodiment. A still further test evaluation was carried out for said type tool construction whereby a single layer of the same polyurethane elastomer employed in the FIG. 2 tool embodiment was substituted for the present multi-part buffer means. While a thickness for said single layer buffer construction was selected so as to provide a contact interface with the reciprocating impact member 24, early tool failure occurred due to overly rapid deterioration of the elastomeric material during tool operation.

It will be apparent from the foregoing description that a broadly useful and novel means has been provided which enables a variety of pneumatic powered impact tools to be operated in a superior manner. It is contemplated that modifications can be made in the specific construction of the present attenuation means, including materials of construction as well as methods for construction other than herein illustrated, however, without departing from the spirit and scope of the present invention. For example, other elastomeric materials than above specifically disclosed can be selected, such as natural rubber and still other deformable synthetic organic polymer materials. Similarly, the multi-part construction for the present attenuation means can further employ additional surface or intervening laminar elements provided to improve operational characteristics of the resulting construction. Accordingly, it is intended to limit the present invention only by the scope of the appended claims.

What I claim as new and desire to secure by Letters Patent of the United States is:

1. A pneumatic powered impact tool having improved vibration and noise attenuation which comprises:

(a) a housing having a central passageway;

(b) a hollow sleeve member closed at a front end and fixed within said housing passageway;

(c) a free piston member slidably engaged within said hollow sleeve member;

(d) a pneumatic valve mechanism supplying a pressurized gaseous medium which drives the piston member forward and back cyclically within said hollow sleeve member;

(e) a reciprocating impact member slidably engaged to the housing by retainer means for interaction with the front end of the hollow sleeve member; and (f) vibration and noise attenuation means interposed between the front end of said hollow sleeve member and said reciprocating impact member, said vibration and noise attenuation means having a laminar configuration formed with a first outer layer of solid elastomeric material, a rigid innerlayer and a second outer layer of solid elastomeric material.

2. The impact tool of claim 1 wherein both outerlayers of elastomeric material have the same composition.

3. The impact tool of claim 1 wherein the outerlayers of elastomeric material have different compositions.

4. The impact tool of claim 1 wherein the rigid innerlayer is metal.

5. A hand-held pneumatic powered chipping tool having improved vibration and noise attenuation which comprises:

(a) a cylindrical housing having a central passageway;

(b) a hollow cylindrical sleeve member closed at a front end and fixed within said housing passageway;

(c) a free piston cylinder slidably engaged within said hollow sleeve member;

(d) a pneumatic valve mechanism supplying pressurized air which drives the piston cylinder forward and back cyclically within said hollow sleeve member;

(e) a replaceable reciprocating chisel member slidably engaged to the housing by retainer means enabling detachment for interaction with the front end of the hollow sleeve member; and (f) vibration and noise attenuation means interposed between the front end of said hollow sleeve member and the back end of said reciprocating chisel member, said vibration and noise attenuation means having a laminar configuration formed with a first outerlayer of said elastomeric material positioned against the front end of said hollow sleeve member, a rigid innerlayer of metal positioned against the first outerlayer, and a second outerlayer of elastomeric material positioned against the metal innerlayer to form a contact interface with the back end of said reciprocating chisel member.

6. The chipping tool of claim 5 wherein both outerlayers of elastomeric material have the same polyurethane composition.

7. The chipping tool of claim 6 wherein the polyurethane composition has a Shore A hardness value of approximately 60.

8. The chipping tool of claim 5 wherein the outerlayers of elastomeric material have different compositions.

9. The chipping tool of claim 5 wherein the rigid metal innerlayer is steel.

10. A hand-held pneumatic powered chipping tool having improved vibration and noise attenuation which comprises:

(a) a cylindrical metal housing having a central passageway;

(b) a hollow cylindrical metal sleeve member closed at a front end in a nose configuration which includes a grooved depression, said metal sleeve member being fixed by press fit within said housing passageway;

(c) a free metal piston cylinder slidably engaged by slip fit within said metal sleeve member;

(d) a pneumatic valve mechanism supplying pressurized air which drives the piston cylinder forward and back cyclically within said metal sleeve member;

(e) a replaceable reciprocating chisel member slidably engaged to the housing by retainer means enabling detachment for interaction with the front end of the metal sleeve member; and (f) vibration and noise attenuation interposed between the front end of said metal sleeve member and the back end of said reciprocating chisel member, said vibration and noise attenuation means having a laminar configuration formed with a first outerlayer of solid elastomeric material lodged within said grooved depression of the metal sleeve member, a rigid innerlayer of metal positioned against the first outerlayer while also lodged within said grooved depression of the metal sleeve member, and a second outerlayer of elastomeric material positioned against the metal inner layer but simply pressing against the nose end of said metal sleeve member to form a contact interface with the back end of said reciprocating chisel member.

11. The chipping tool of claim 10 wherein both outerlayers of elastomeric material have the same polyurethane composition.

12. The chipping tool of claim 11 wherein the polyurethane composition has a Shore A hardness value of approximately 60.

13. The chipping tool of claim 10 wherein the outerlayers of elastomeric material have different compositions.

14. The chipping tool of claim 10 wherein the rigid metal innerlayer is steel.

* * * * *